US005910793A

United States Patent [19]

Rogovin et al.

[11] Patent Number: 5,910,793

[45] Date of Patent: Jun. 8, 1999

[54] METHOD AND APPARATUS FOR ENHANCING THE SELECT/NONSELECT RATIO OF A LIQUID CRYSTAL DISPLAY

[75] Inventors: Daniel Rogovin; Tsae-Pyng Janice Shen, both of Thousand Oaks; Yuval Fisher, Del Mar, all of Calif.

[73] Assignee: Rockwell International Corporation, Costa Mesa, Calif.

[21] Appl. No.: 08/743,378

[22] Filed: Nov. 1, 1996

[51] Int. Cl.[6] ..... G09G 3/36

[52] U.S. Cl. ..... 345/100; 345/94

[58] Field of Search ..... 345/87, 89, 100

[56] References Cited

FOREIGN PATENT DOCUMENTS

A 0595495 5/1994 European Pat. Off. .

*Primary Examiner*—Matthew Luu
*Attorney, Agent, or Firm*—Kyle Eppele; James P. O'Shaughnessy

[57] ABSTRACT

The inventive method calculates the column coefficients for a liquid crystal display panel. By using this method, the invention shows that the select/nonselect ratio can be maximized by the following ways: (1) Scaling the image to the maximally physically realizable select/nonselect ration via the following equation $$f_J^N(\langle V_{J,M}^2\rangle; F) = \frac{4\sum_{M=1}^{N}\langle V_{J,M}^2\rangle}{F^2} - \frac{\left(N\sum_{M=1}^{N}\langle V_{J,M}^2\rangle^2\right) - \left(\sum_{M=1}^{N}\langle V_{J,M}^2\rangle\right)^2}{F^4} - 4(N-1),$$

(2) Choosing an optimum value for row rms voltage "F", (3) Altering the statistics of an image, to reduce the variance of the different columns and/or increase the average of the columns, (4) Altering an image through fastest ascent or minimal error methods and (5) Designing the image to be predominantly at high rms voltage states. The select/nonselect ratio determines the available voltage range to achieve gray scale or variation in intensity. By maximizing the select/nonselect ratio, the present invention is able to obtain a wider range of intensity variation, i.e. larger contrast ratio.

4 Claims, 3 Drawing Sheets

METHOD AND APPARATUS FOR ENHANCING THE SELECT/NONSELECT RATIO OF A LIQUID CRYSTAL DISPLAY

BACKGROUND OF THE INVENTION

This invention relates to a liquid crystal display and, more particularly, to a method and an apparatus for driving a passive liquid crystal display with an enhanced select/nonselect ratio.

Large passive liquid crystal displays suffer from serious contrast problems due to the manner in which the display elements are actuated. A typical passive liquid crystal display 10 is shown in simplified schematic form in the FIG. 1. A display panel 12 has a plurality of horizontally row electrodes or lines 14 extending perpendicularly to a plurality of column electrodes or lines 16. The crossing points of the lines 14 and 16 define pixels 18 for displaying visual information. For illustration purposes, the display is shown as having four row lines 14, R1 through R4, and five column lines 16, C1 through C5. In practice there are often hundreds of rows and columns.

Voltages are applied to the columns and the rows, and a pixel having both its row and column carrying a voltage is addressed. Liquid crystal display devices typically use what is generally referred to as "line at a time" addressing method, which is depicted by the wave forms shown in FIG. 2. All of the column lines 16 are activated simultaneously by the application of a column voltage wave form $V_C(t_K)$ having a plurality of pulses. The row lines 14 are each turned on for a fixed period of time in sequence. Specifically, at a time $t_1$, a first row voltage wave form $V_{R1}(t_K)$ includes a pulse which is applied to the row line R1, while an associated column voltage pulse is applied to column lines C1 through C5 such that all of the pixels 18 in the first row of the display panel 12 are activated. At a time $t_2$, after the first row voltage pulse has been terminated, a second row voltage wave form $V_{R2}(t_K)$ applies a pulse to the row line R2 while an associated column voltage pulse is applied to the column lines C1 through C5 such that the second row of the pixels 18 in the display panel 12 is activated. Similarly, row voltage wave forms $V_{R3}(t_K)$ and $V_{R4}(t_K)$ apply pulses to the row lines R3 and R4 respectively; at the times $t_3$ and $t_4$, respectively, to activate the pixels 18 in the third and fourth rows, respectively. Once activated, the pixels remain at the same state for a limited period of time (referred to as the decay time).

In a large passive display, the pixels 18 located in the upper rows may have relaxed entirely before the lower rows are addressed such that the image in those upper row portions of the display will fade. This results in a low contrast ratio. The problem assumes critical importance when the device is run in a video mode, where short relaxation times are required.

One attempt to deal with this problem has been a method wherein all of the rows are driven simultaneously. The formulas for setting the voltages on the columns include a coefficient. In a prior art, a column coefficient was presetted, and plugged into the formulas used to calculate the required voltages. However, for images that have more than one bit of gray scale, this has resulted in a coupling between the different pixels in a given column. This coupling manifests itself such that the required rms (root mean square) voltage to achieve a particular light transmission intensity in a given pixel depends on the state of all of the other pixels in that column. Decoupling the various pixels within a column from one another requires the use of a virtual row.

In addition, with this approach, the so called Alt and Pleshko limit has been understood in prior art to place a theoretic maximum to the select/nonselect ratio. The select/nonselect ratio is the rms voltage range between a low limit and a high limit attainable with the driving signals. The liquid crystal material determines the on and off states of display corresponding to these voltage limits. It is between these limits that any gray scale, or variation in the intensity of a particular pixel, must be achieved. A designer of LCDs would like to maximize the select/nonselect ratio for several reasons. The video mode requires fast liquid crystal materials with short relaxation times to minimize "ghosting". The faster liquid crystal material in general has much less steep BV curve and hence the larger select/nonselect ratio is essential to have required high contrast ratio. Moreover, larger select/nonselect ratio allows for more accurate specification of gray and hence larger available number of gray levels.

SUMMARY OF THE INVENTION

The present invention allows the select/nonselect ratio to be maximized by explicitly computing the optimal column coefficients for an image or a set of images. The column coefficients are optimal in the sense that they achieve the highest physically achievable select/nonselect ratio, often significantly higher than the Alt and Pleshko limit. Moreover, the present invention shows how minor, visually imperceptible, or visually tolerable modifications to the image can significantly increase the select/nonselect ratio.

The present invention shows that by minimizing the column variance or by making each of the columns as uniform as possible, the select/nonselect ratio is maximized. In addition, the present invention shows the select/nonselect ratio can be increased when the majority of the display is on, as opposed to off. The last two features point to the LCD designer selecting a display design wherein the maximum area is on, rather than off. In addition, the present invention points to minimizing variance in voltage along any one column. The optimization of the particular displays may be performed manually when designing the display, or in some circumstances could be performed by a computer generated system or a graphic engine.

BRIEF DESCRIPTIONS OF THE DRAWINGS

DETAILED DESCRIPTION OF THE PREFERRED EMBODIMENTS

Figure 1:
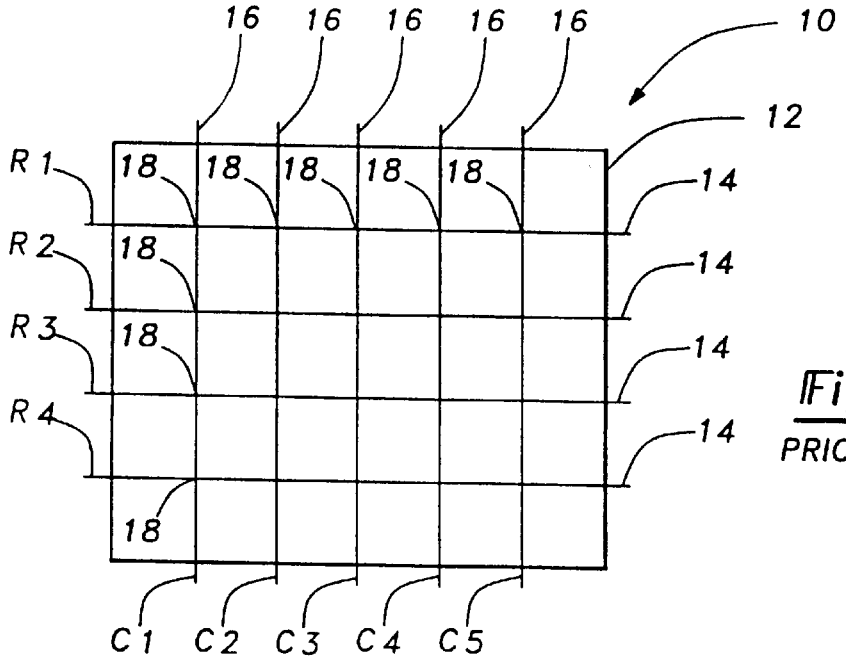
Fig-1 PRIOR ART
FIG. 1 is a schematic view of a prior art liquid crystal display panel.
Figure 2:
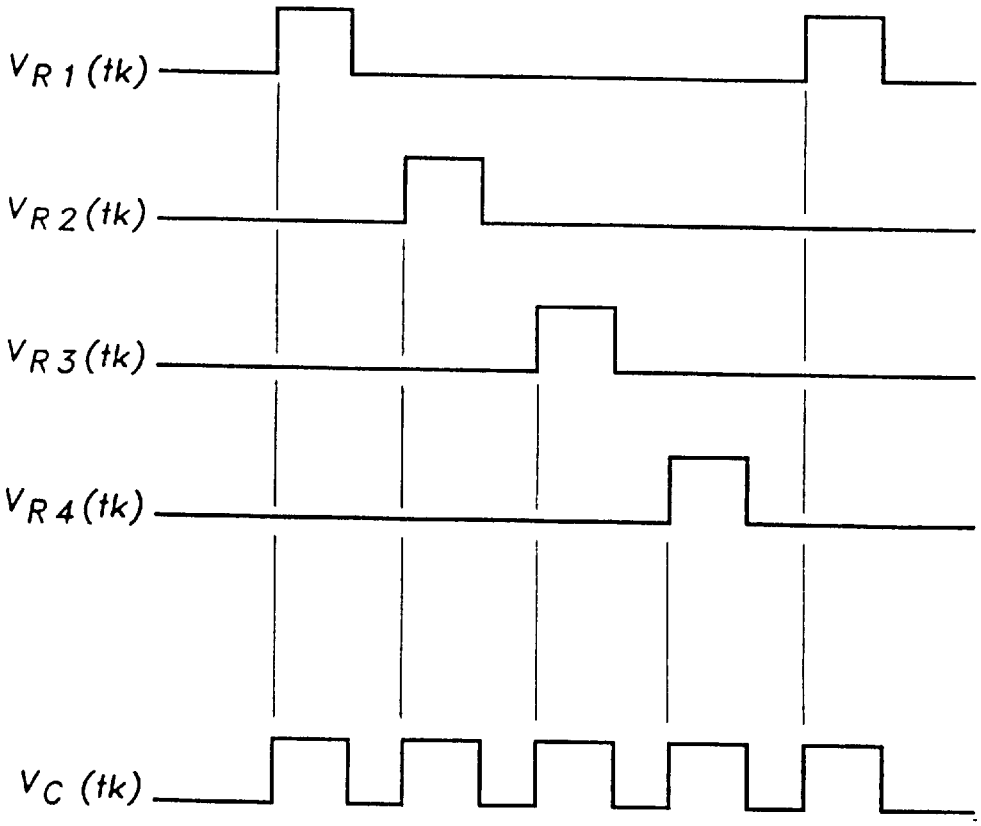
Fig-2 PRIOR ART
FIG. 2 is a wave form diagram of the addressing voltages applied to drive the row and column lines of the display panel shown in the FIG. 1 as used in the prior art.
Figure 3:
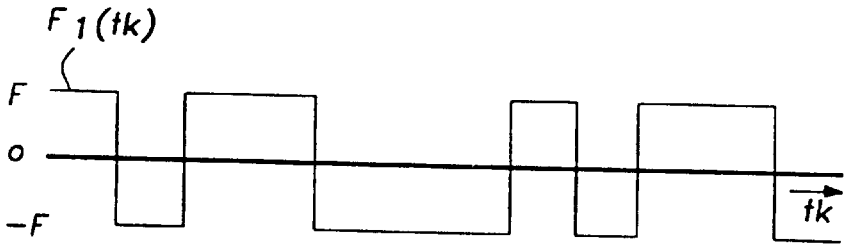
FIG. 3 is a wave form diagram of the row addressing voltages according to the present invention.
Figure 4:
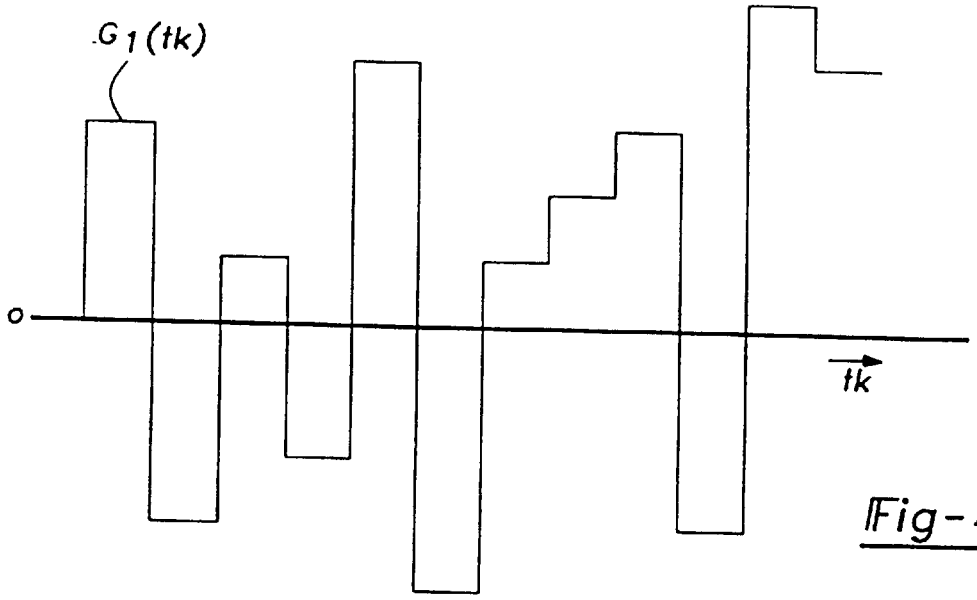
FIG. 4 is a wave form diagram of the column addressing voltages according to the present invention.

The present invention uses a distinct mathematical approach to determine the control voltages for the passive LCD display. By using this distinct mathematical approach, the present invention obtains select/nonselect ratios that are far beyond the limits that constrained the prior art. An understanding of the relevant mathematics is necessary to fully appreciate this invention. Low contrast ratios for a passive liquid crystal display in a video mode are addressed by exciting some or all of the rows at the same time. A set of orthogonal functions is used to represent the row voltages, and the column voltages are expressed as a linear combination of these row voltages. For example, $F_M(t_K)$ can represent any set of orthogonal functions defined on a collection of equal time intervals: $t_1, t_2 \ldots, t_M$ ($M=2^q>N$, where q is an integer and N is equal to the number of rows in the display). The instantaneous voltage of the $J^{th}$ column during the time interval $t_K$ is defined by a first equation:

$$G_J(t_k) = \sum_{M=1}^{N} a_{J,M} F_M(t_k) \quad \text{(Eq. 1)}$$

where the variables $a_{J,M}$ are a set of real coefficients that will be specified below. The two wave forms defined by the orthogonal functions have the general shape shown in FIG. 3, wherein $F_I(t_K)$ is the row voltage applied in the $I^{th}$ row line, and in FIG. 4, wherein $G_J(t_K)$ is the column voltage applied to the $J^{th}$ column line.

$F_M(t_K)$ is typically, but not necessarily, selected to be a complete set of bilevel or trilevel functions with values ±F or (±F,0). The time interval chosen for each segment (i.e., the $t_K$) is on the order of tens of microseconds. Thus, the row voltage drivers are typically digital devices and the column voltage drivers, since the column voltages are linear combinations of the row voltages, can be either analog or digital drivers.

The total instantaneous voltage across a pixel (I,J) at the time $t_K$ is defined by a second equation:

$$V_{I,J}(t_K)=F_I(t_K)-G_J(t_K) \quad \text{(Eq. 2)}$$

Liquid crystals exhibit approximately a mean square response to short time electrical excitations and the mean square voltage across a pixel (I,J) is defined by a third equation:

$$\langle V_{I,J}^2 \rangle = F^2\left(1 + \sum_{M=1}^{N} a_{M,J}^2 - 2a_{I,J}\right) \quad \text{(Eq. 3)}$$

The row functions are usually taken to be orthogonal, in which case the third equation, or variation in the intensity of any pixel, is of fundamental importance as it links the image, through the mean square pixel voltage $\langle V^2_{I,J}\rangle$, to the voltage wave forms $G_J(t_K)$ via the coefficient $a_{I,J}$. Gray scale, or varying degrees of brightness at any one pixel, is obtained via amplitude modulation of the voltages.

An examination of the third equation reveals that there are two approaches for driving images on a panel: (1) either specify the coefficient $a_{I,J}$ and use the third equation to calculate the mean square voltage $\langle V^2_{I,J}\rangle$, or (2) specify the mean square voltage $\langle V^2_{I,J}\rangle$ and use the third equation to calculate the coefficient $a_{I,J}$. The first approach is the conventional choice. The apparatus and method according to the present invention disclosed in copending application Ser. No. 08/710,472, entitled "Method and Apparatus for Driving a Liquid Crystal Display", utilizes the second approach.

It might appear that the second approach requires a great deal of extra calculations compared to the first approach to obtain all of the "a" coefficients necessary to generate an image on a liquid crystal display panel. This, however, is not the case. It is sufficient to solve for the sum of the squares of the "a" coefficient, for which a quadratic expression exists, given below, that can be easily solved. This is not known in the prior art.

$$2a_{I,J} + \frac{\langle V_{I,J}^2 \rangle}{F^2} = 1 + \sum_{M=1}^{N} a_{M,J}^2 = Q_J \quad \text{(Eq. 4)}$$

As an immediate consequence of this, we require only a single "a" coefficient in a given column because the various "a" coefficients for different rows of the same column are related by $$2a_{I,J} + \frac{\langle V_{I,J} \rangle}{F^2} = 2a_{I,J} + \frac{\langle V_{I,J}^2 \rangle}{F^2} \quad \text{(Eq. 5)}$$

To solve for the sum of the squares of the "a" coefficients, the following quantity, set forth as a sixth equation, must be positive:

$$f_J^N(\langle V_{J,M}^2 \rangle; F) = \frac{4\sum_{M=1}^{N} \langle V_{J,M}^2 \rangle}{F^2} - \frac{\left(N\sum_{M=1}^{N} \langle V_{J,M}^2 \rangle^2\right) - \left(\sum_{M=1}^{N} \langle V_{J,M}^2 \rangle\right)^2}{F^4} - 4(N-1) \quad \text{(Eq. 6)}$$

for the coefficient $a_{I,J}$ to be real.

A set of desired rms voltages can be scaled to maximize the select/non-select ratio until at some critical point the resulting scaled rms voltages are no longer physically realizable (by any of the addressing schemes discussed above). Equation 6 changes from being positive to negative at this critical scaling. Therefore, this equation can be used to determine the maximum physically realizable scaling and hence the maximal select/non-select ratio. That is, equation 6 must be positive, and thus it sets the limits of the select/nonselect ratio to those values that result in a positive solution.

Increasing the first term and decreasing the next two terms allow for more scaling of the rms voltages and therefore a higher select/non-select ratio. There are various ways to alter these terms: it is possible to alter the gray values, or to select the voltages for the gray levels to achieve this goal; it is possible to alter the image in other ways, for example by setting some white pixels to gray; it is possible to select the closest image (say in the rms metric) for which equation 6 is zero, and hence for which a solution exists; it is possible to scale the image in some non-uniform way to achieve the same goal.

Thus, it can be shown with reference to Equation 6, that maximizing the sum of the three terms in Equation 6 corresponds to maximizing the select/nonselect ratio. The first term should typically be maximized while the next two terms would preferably be minimized. Such an approach will maximize the select/nonselect ratio.

The first aspect optimizes the first term on the right hand side of the sixth equation, which is the total pixel square voltage of the entire column. This term is preferably maximized. Thus, images whose pixel statistics are dominated by high mean square voltage values will have greater select/nonselect ratios than those images that have statistics that are dominated by low mean square voltage values. Thus, the present invention recognizes that highly "on", displays provide greater select/nonselect range for a normally black display. If an image from a normally white display that is predominantly light is reversed, i.e., all of the "off" pixels are turned "on", then the contrast ratio and the image quality are improved for the processed (i.e., the inverse) image when it is displayed on a panel.

The second aspects optimize the next two terms on the right hand side of the sixth equation, which are the column variance. Since they are subtracted from the first term, it would be desirable to minimize these terms. Greater select/nonselect ratios can be obtained for low variance images, e.g., faces or symbolism that lacks checkerboard patterns. In all cases, the present invention achieves at least the Alt & Pleshko limit.

The third aspect recognizes the term $f^N_J(<V^2_{J,M}>;F)$ is an inhomogeneous function of "F", the row voltage. This implies that there is an optimum value of "F" for any column. By extension, there is an optimum value of "F" for any image. That is, one can find an optimum "F" which results in the greatest selection ratio while keeping Equation 6 non-negative. This feature often enables the select/nonselect ratio to be extended by a factor of 50% to 100% over the Alt and Pleshko limit. This qualitatively improves the images exhibited on a liquid crystal display panel. The contrast ratio of an image can be further enhanced by the appropriate choice of the rms voltages corresponding to the different gray scale values of the images.

We now discuss several schemes for altering an image, often imperceptibly, to increase its select/nonselect ratio. Method I for increasing the select/nonselect ratio uses minimal error. Let $I_1$ be an image consisting of a collection of gray levels. It is possible to scale $I_1$ so that its select/non-select ratio is not physically realizable. It is then possible to compute the image $I_2$ which is closest to the scaled $I_1$ in the mean square sense and keeps equation 6 non-negative. This image will have the highest possible select/nonselect ratio while having the minimal error difference from $I_1$.

Method II for increasing the select/nonselect ratio uses fastest ascent as follows. Start with an image $I_1$ that has too high a select/nonselect ratio. Alter each column, as a vector, in the direction of fastest change of equation 6. This is a differential equation with an exact solution. The columns are altered so that equation 6 becomes non-negative, at which point the image can be displayed using the solution described before and in the above referenced patent application "Method and Apparatus for Driving a Liquid Crystal Display."

Method III for increasing the select/nonselect ratio uses a variety of filters to decrease the variance and increase the average terms of equation 6. These filters can, for example, smooth the image (decreasing the variance) or change gray levels (increasing the average).

Figure 5:
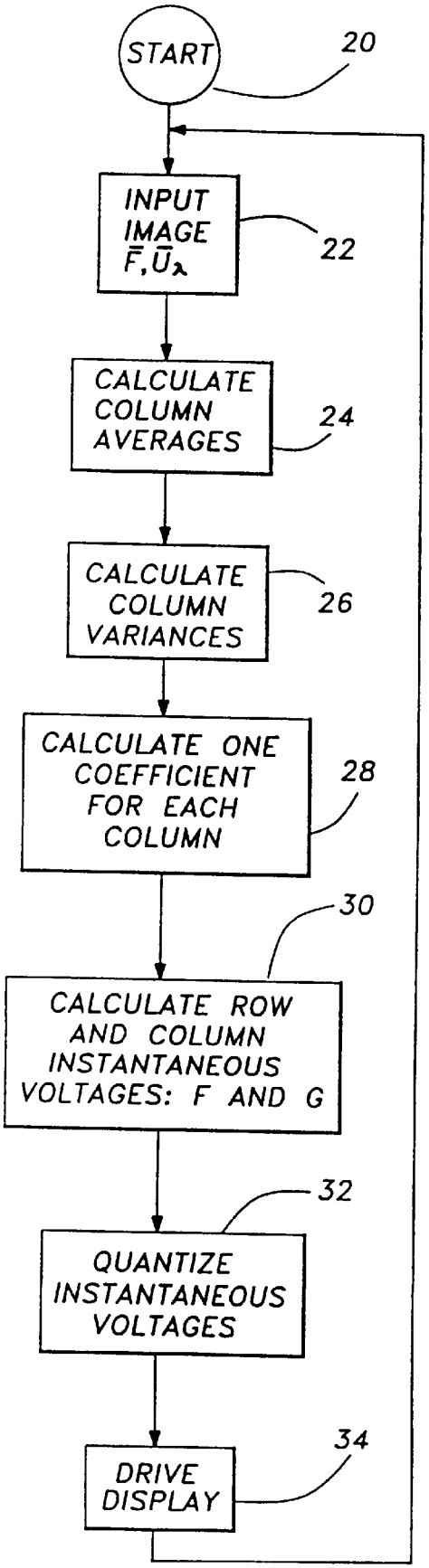
FIG. 5 is a flow diagram of the method of driving a liquid crystal display panel according to the present invention.

A flow chart of the method for driving a liquid crystal display panel to display an image is shown in FIG. 5. The method begins at a circle START 20 and enters an INPUT IMAGE (F, $U_\lambda$), where $\lambda$ is a set of three indices which specify the gray scale and position of the pixel, instruction set 22 wherein the data for the image that is to be displayed on the liquid crystal display panel is read in as a set of gray scale values, one rms voltage $U_\lambda$ for each pixel. The rms voltage $U_\lambda$ can be modified according to the aforementioned three methods before instruction set 24. The method then enters a CALCULATE COLUMN AVERAGES instruction set 24, wherein the rms voltages assigned for each gray scale value are calculated as represented by the first term on the right hand side of the sixth equation. The method then enters a CALCULATE COLUMN VARIANCES instruction set 26, where the variance of mean square pixel voltages for the entire column are calculated as represented by the next two terms on the right hand side of the sixth equation. The method next enters a CALCULATE ONE COEFFICIENT FOR EACH COLUMN instruction set 28 wherein the previously calculated values are used to calculate one $a_{J,J}$ coefficient for each column according to the ninth equation as set forth below. All of the other "a" coefficients in a given column are determined by using the fifth equation set forth above.

The method next enters a CALCULATE ROW AND COLUMN INSTANTANEOUS VOLTAGES: F AND G instruction set 30 to evaluate the column voltages $G_J(t_K)$, for each column "J" and each time interval $t_K$, according to the first equation set forth above. As previously stated, "N" is the number of rows and $F_M(t_K)$ is a complete set of discrete, orthogonal functions; e.g., the Walsh functions or the pseudorandom functions. The column voltages can be calculated using the equations 7–10 below. Thus, if all of the $a_{J,M}$ coefficients in the column "J" are referenced to a particular pixel in that column, say the pixel positioned in the row "L", then the voltage can be written as a seventh equation:

$$G_J(t_k) = \left(a_{L,J} + \frac{\langle V^2_{L,J}\rangle}{F^2}\right)R(t_k) - \frac{\sum_{M=1}^{N}\langle V^2_{J,M}\rangle F_M(t_k)}{F^2} \quad \text{(Eq. 7)}$$

wherein $R(t_K)$ is defined by an eighth equation:

$$R(t_k) = \sum_{M=1}^{N} F_M(t_k) \quad \text{(Eq. 8)}$$

The $a_{L,J}$ coefficients are calculated using a ninth equation:

$$a_{L,J} = \frac{-\left(\sum_{M=1}^{N} X^J_{L,M} - 2\right) - \sqrt{\left(\sum_{M=1}^{N} X^J_{L,M} - 2\right)^2 - 4N\left(\frac{1}{4}\sum_{M=1}^{N}\{X^J_{L,M}\}^2 + 1 - \frac{\langle V^2_{L,J}\rangle}{F^2}\right)}}{2N} \quad \text{(Eq. 9)}$$

where $X^J_{L,M}$ is defined by a tenth equation:

$$X^J_{L,M} = \left(\frac{\langle V^2_{L,J}\rangle - \langle V^2_{M,J}\rangle}{2F^2}\right) \quad \text{(Eq. 10)}$$

As mentioned above, the mean square voltage quantities are preset. F is the row rms voltage and is also known. Equations 9 and 10 are used to calculate a first coefficient in each column. The other coefficients are then easily determined using Equation 5. After the column voltages have been computed, the method enters a QUANTIZE INSTANTANEOUS VOLTAGES instruction set 30 to generate the column and row drive voltages to the discrete column and row drivers. These quantized instantaneous drive voltages are applied to the column and row lines by a DRIVE DISPLAY instruction set 34, whereupon the dynamical response of the liquid crystal material rotates the directors in accordance with the instantaneous drive voltages. The method returns to the instruction set 22 to obtain the next image.

Figure 6:
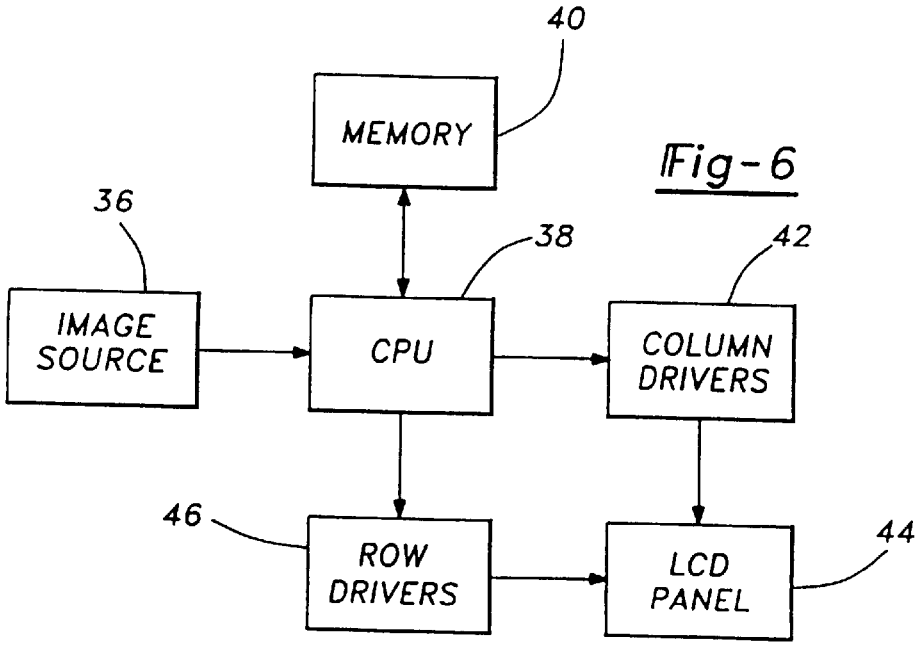
FIG. 6 is a schematic block diagram of an apparatus for driving a liquid crystal display panel according to the present invention.

An apparatus for driving a liquid crystal display panel in accordance with the present invention is shown in FIG. 6. A source of images 36 has an output connected to an input of a computational engine CE 38. The image's source can be any type of conventional signal source, such as a vehicle instrument panel display, a television camera, or an optical storage device, which generates information signals representing an image to be displayed. The CE 38 has an input/output connected to an input/output of a memory 40, which stores an operating program for performing the method according to the present invention and the values calculated by the CE during execution of the operating program. A first output of the CE 38 is connected to an input of a column drivers circuit 42, which has an output connected to the column lines of a LCD (liquid crystal display) panel 44. A second output of the CE 38 is connected to an input of a row drivers circuit 46, which has an output connected to the row lines of the LCD panel 44. Thus, the CE 38 responds to the image information received from the images source 36 by modifying the image information to maximize the select/nonselect ratio and then generating control signals to the driver circuits 42 and 46. The driver circuits 42 and 46 respond to the control signals by generating all of the column and row drive voltage wave forms simultaneously to cause the image to be displayed by the LCD panel 44 with an enhanced select/nonselect ratio in accordance with the method according to the present invention. In a preferred implementation the CE may be an ASIC (Application Specific Integrated Chip).

Figure 7:
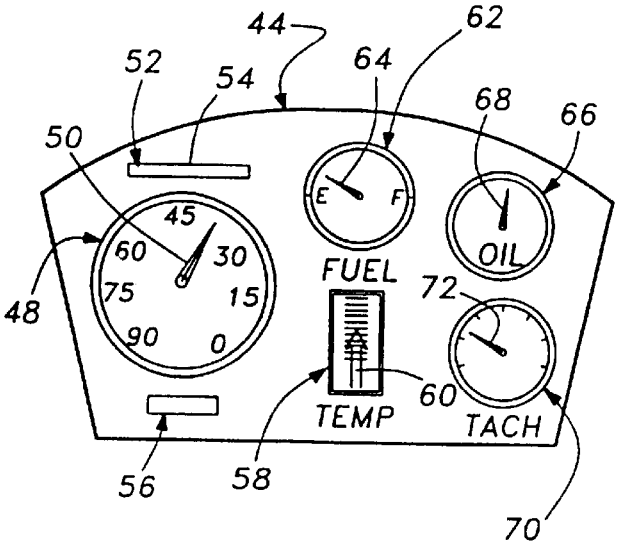
FIG. 7 is a schematic view of the liquid crystal display panel shown in the FIG. 6 functioning as an automotive information display panel.

The display panel 44 has many applications, such as a vehicle display panel, a portable computer display, a factory automation display, and a personal computer monitor among others. Display panel 44 is shown in FIG. 7 as an automotive information display panel. The displayed automotive information can include a speedometer image 48 as an option. The bar graph image 52 has a shaded portion 54, which moves horizontally to represent the speed of the vehicle beginning at zero and a left hand edge. Below the speedometer image 48 is shown an odometer image 56 for indicating accumulated mileage.

The center portion of the display panel 44 includes a temperature gauge image 58 configured as a vertical scale similar to a conventional thermometer. The gauge image 58 includes a vertically movable temperature needle 60, which indicates the temperature of the vehicle engine cooling fluid. This type of display minimizes contrast in the affected columns, and thus improves the select/nonselect ratio. An analog fuel gauge image 62 has a fuel level needle 64 movable between empty and full positions to indicate the quantity of fuel in the vehicle fuel tank. To the right of the fuel gauge image 62, there is shown an analog oil gauge image 66 having an oil pressure needle 68 movable between zero and maximum pressure positions to indicate the oil pressure in the vehicle engine. Below the oil gauge image 66, there is shown a tachometer image 70 having a tachometer needle 72 movable between zero and maximum value to indicate the speed of the vehicle range in r.p.m.

The images 48, 52, 56, 58, 62, 66 and 70 are illustrative of the types of information that can be displayed on the liquid crystal display panel 44. These images can be displayed in black and white or in various color combinations with several levels of gray scale.

Further, a vehicle instrument panel display shown in FIG. 7 has been modified to include aspects that will typically maximize the select/nonselect ratio. As one example, the oil temperature includes a scale moving vertically through the columns. In this way, the column variance would be minimized. In addition, many of the other displays are shown as dark thin lines on a relatively brightly lit background for a normally black display. In this way, the mean square voltage is maximized for the overall display. A LCD designer may simply design this into the system manually. Alternatively, algorithms may be developed which are weighted to prefer these types of features and are used to design the displays.

This invention offers a number of pathways that can be used to enhance the select/nonselect ratio beyond the Alt and Pleshko limit. These pathways are:

1) Scaling the image to the maximally physically realizable select/nonselect ratio via equation 6.

2) Choosing an optimum value for the row rms voltage "F".

3) Altering the statistics of an image, to reduce the variance and/or increase the average of the different columns.

4) Altering an image through fastest ascent or minimal error methods.

5) Designing the image to be predominantly at high rms voltage states.

Maximizing the select/nonselect ratio will often be done in the initial design of a particular display. That is, the designer may manually determine preferred orientations and lighting schemes to maximize the select/nonselect ratio for the particular display. Alternatively, computer programs could be developed, and the desirable factors given preferred weighing for designing the displays. To this end, some of the optimization of the appearance of the design can be automated. In sample systems, which are automotive instrument panel-type displays it has been found that the optimal F is from 1.5 to 2.5. Of course, the F value for any given system may vary.

The foregoing description is exemplary rather than limiting in nature. Variations and modifications of the disclosed embodiments will become apparent to those skilled in the art that do not depart from the purview and spirit of this invention. The scope of this invention is to be limited only the appended claims.

What is claimed is:

1. A method for driving a liquid crystal display panel to display an image comprising the steps of:

a. reading information signals representing an image to be displayed;

b. modifying the information signals to maximize the select/nonselect ratio, c. calculating column voltage averages for all column lines of a liquid crystal display panel;

d. calculating column voltage variances for all the column lines of the liquid crystal display panel;

e. calculating the coefficients for each of the column lines of the liquid crystal display panel;

f. specifying instantaneous voltages for all row lines of the liquid crystal display panel and calculating instantaneous voltages for all of the column lines of the liquid crystal display panel using the column voltage averages, the column voltage variances and the column coefficients wherein a total instantaneous voltage across a pixel at an intersection of a $J^{th}$ column line and an $I^{th}$ row line at a time $t_K$ is defined by an equation $$V_{L,J}(t_K)=F_I(t_K)-G_J(t_K)$$

$G_J(t_K)$ is the column drive voltage wave form applied to the $J^{th}$ column line defined by an equation $$G_J(t_k)=\left(a_{L,J}+\frac{\langle V_{L,J}^2\rangle}{F^2}\right)R(t_k)-\frac{\sum_{M=1}^{N}\langle V_{J,M}^2\rangle F_M(t_k)}{F^2}$$

$F_M(t_K)$ is a set of orthogonal functions defined on a collection of equal time intervals $t_1$, $t_2$, . . . , $t_M$, $M=2^q>N$, where q is an integer and N is equal to the number of the row lines in said panel, the variables $a_{J,M}$ are a set of real coefficients, F is a constant and is optimized to increase the select/nonselect ratio; and g. quantizing and applying the instantaneous voltages to all of the row lines and all of the column lines of the liquid crystal display panel simultaneously to generate a display of the image.

2. A method as recited in claim 1, wherein said method further modified the displayed image by finding another image that has minimal error and largest possible selection ratio, or another image which has largest possible selection ration and is derived from the original image by the method of fastest ascent.

3. A method as recited in claim 1, wherein said method further includes the steps of minimizing the column voltage variance and/or maximizing the column average in at least the majority of the column lines.

4. A method as recited in claim 2, wherein said method further includes the steps of selecting the majority of said display to be at high rms voltage states as opposed to at low rms voltage states.

* * * * *